United States Patent [19]

Thiessen

[11] 4,158,408

[45] Jun. 19, 1979

[54] PACKAGE FOR CANDY CANES

[76] Inventor: Fred L. Thiessen, 405 Bouziden, Moore, Okla. 73160

[21] Appl. No.: 912,210

[22] Filed: Jun. 5, 1978

[51] Int. Cl.[2] ..... B65D 85/20; B65D 1/36

[52] U.S. Cl. ..... 206/443; 206/526; 206/564

[58] Field of Search ..... 206/443, 422, 365, 332, 206/486, 223, 461, 590, 526, 564; 211/13

[56] References Cited

U.S. PATENT DOCUMENTS

| | | | |
|---|---|---|---|
| 1,755,234 | 4/1930 | Westerfield | 206/443 |
| 2,883,061 | 4/1959 | Moore | 211/13 |
| 3,013,656 | 12/1961 | Murphy, Jr. | 206/223 |
| 3,608,706 | 9/1971 | Vigue | 206/422 |

*Primary Examiner*—William T. Dixson, Jr.
*Attorney, Agent, or Firm*—William R. Laney

[57] ABSTRACT

A package for candy canes which is a body of resilient, synthetic resin material having a pair of adjacent cane-receiving depressions therein. Each of the cane-receiving depressions is of an elongated oval configuration, and includes substantially elongated side channels separated by a central island and joined at each end by a rounded, recessed end portion. Intermediate the length of each of the elongated side channels of the recessed elongated oval, a pair of undercut flanges are provided within the recess forming that side of the oval, and adjacent the central island. The undercut flanges in each pair are spaced a distance from each other which is less than the transverse thickness of the elongated leg of a candy cane to permit the cane to be snapped between the flanges through the space therebetween, and then retained by the flanges in a stored, packaged position. A support pedestal extends between the sides of the defining boundaries of each of the side channels of the oval at a location between and below the undercut flanges, and functions to support a portion of a cane snapped between the flanges, and to space the cane from the remainder of the synthetic resin body. The synthetic resin material is of sufficient resilience, and the undercut flanges are so dimensioned, that the canes may be easily removed from the package by snapping them out through the space between the opposed undercut flanges.

8 Claims, 4 Drawing Figures

PACKAGE FOR CANDY CANES

BACKGROUND OF THE INVENTION

Brief Description

This invention relates to packages for frangible objects, and more particularly, to packaging for candy canes having an elongated leg joined to a U-shaped portion at one end of such leg.

BRIEF DESCRIPTION OF THE PRIOR ART

Various types of packaging have been used for storing a plurality of articles during shipment, and prior to opening of the package and use of the articles packaged, in such manner that these articles can be snapped into position in the package during packaging, and manually removed when the package is opened by snapping them out of engagement with certain resilient flanges or portions of the package in which they are located. In some instances, the articles to be packaged are extremely delicate and susceptible to breakage during storage and shipment. It is necessary by the mode of packaging, and the construction of the package used, to attempt to insulate the packaged articles from sudden impact forces or shock received during transport, and also from crushing forces which may occur at the time of storage.

Prior patents which have been issued on this type of package include Seeley U.S. Pat. No. 4,005,776; Millet U.S. Pat. No. 4,015,709; Castner U.S. Pat. Nos. 3,648,836 and 3,233,729; Tingley U.S. Pat. No. 3,116,730; Rocchi et al. U.S. Pat. No. 3,048,268; Metz U.S. Pat. No. 2,969,146; MacGregor U.S. Pat. No. 1,980,141, and Little U.S. Pat. No. 1,944,606.

A package for receiving and storing candy canes is shown in Westerfield U.S. Pat. No. 1,755,234. The construction of the Westerfield package is such that large portions of the packaged candy canes are in direct contact with outside walls of the package and thus are subject to breakage as the package is jostled, dropped or sharply impacted.

BRIEF DESCRIPTION OF THE PRESENT INVENTION

This invention provides a package which is specifically adapted for the containment of frangible candy in the form of miniature canes, or what are frequently referred to in the trade as candy canes. This candy is hard and frangible as it is manufactured and sold, and it is therefore necessary to package it for shipment and storage in a way which protects the canes from impact and crushing forces.

Broadly described, the package of the invention comprises a shaped body of synthetic resin material having a plurality of depressions formed in the body for receiving the candy canes. In a preferred embodiment of the invention, the body of synthetic resin is made up to accommodate the canes by placement of a pair of canes in each of two generally oval-shaped depressions formed in the body. Each oval-shaped depression includes a pair of substantially parallel elongated side channels which are separated by a central island with these elongated sides joined at their ends by rounded, recessed end portions.

Intermediate the length of each of the elongated side channels of each of the recessed, elongated ovals, a pair of undercut flanges is provided. These flanges face each other so as to form a narrow mouth or opening between them through which the elongated leg of one of the candy canes can be pressed or snapped into a retained position. In other words, the undercut flanges of each of the pair of flanges are spaced from each other by a distance which is less than the transverse thickness of the elongated leg of a candy cane to be held in the package. A supporting means is formed in the body and extends upwardly from the lower side of the body between the walls which define the boundaries of each of the side channels of the elongated oval depressions. The supporting means is positioned in each side channel of each oval depression at a location which is at about the location therealong of the flanges, and is spaced downwardly from the mouth opening between these flanges. The supporting means functions to support a portion of the leg of a candy cane snapped between the flanges, and to space the cane from the remainder of the synthetic resin body at the end of the cane leg and the crook of the cane. The synthetic resin material of which the body is constructed is of sufficient resilience, and the undercut flanges are so dimensioned, that the canes may be easily removed from the package by snapping them out through the space between the undercut flanges.

An important object of the invention is to provide a package for candy canes, by the use of which package such canes can be stored compactly in a package for shipment and storage without subjecting the canes to external shock forces due to impact forces or crushing loads imposed upon the package.

Another object of the invention is to provide a package for candy canes by which the canes can be exposed from the top of the package in an aesthetic manner as they are placed in the package.

A further object of the invention is to provide a package for candy canes which is strong and durable in its construction, yet possesses sufficient resilience that it does not fracture upon being dropped.

Yet another object of the invention is to provide a package for candy canes which retains the canes in a minimum space, and in a flat position so that the packages can be superimposed upon each other and thus positioned to occupy minimum space during shipment and storage.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
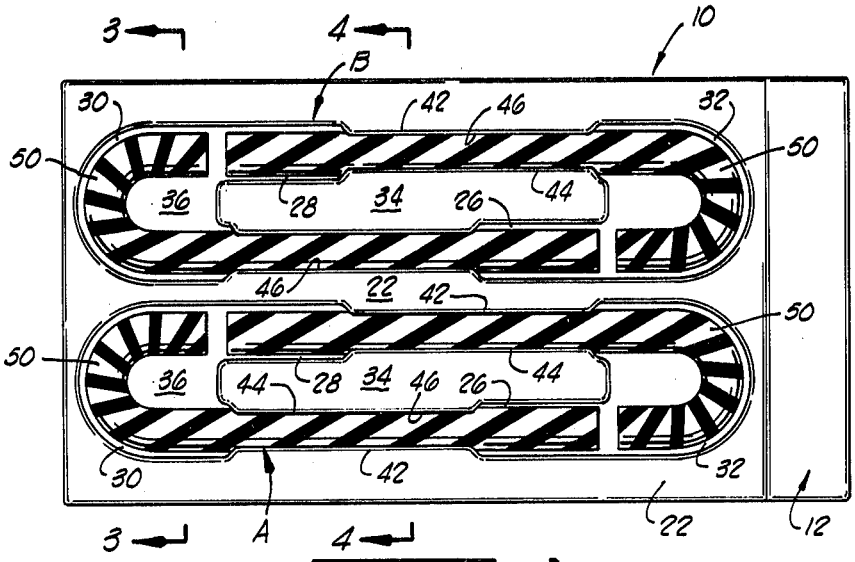
FIG. 1 is a plan view of a preferred embodiment of the candy cane package of the invention, illustrating four candy canes in their packaged position.
Figure 2:
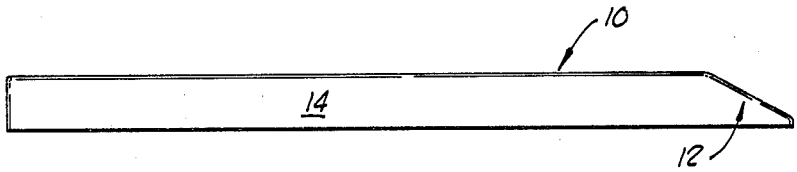
FIG. 2 is a side elevation view of the candy cane package illustrated in FIG. 1.

The package of the invention comprises a body 10 of resilient synthetic resin material. As illustrated in FIGS. 1 and 2, the overall configuration of the body is that of a rectangular parallelepiped, except that in side elevation the body has a trapezoidal appearance by reason of an inclined or tapered end portion 12 adjacent one end thereof. The body is preferably molded from a single piece of synthetic resin material and, as molded, includes a pair of opposed, longitudinally extending side walls 14 and 16 which are joined at one end to a transversely extending end wall 18, and at the other end to the tapered end portion 12. The tapered end portion 12 includes an inclined plate or panel 20 which extends between the side walls 14 and 16, and intersects at its upper edge, a top panel 22.

Figure 3:
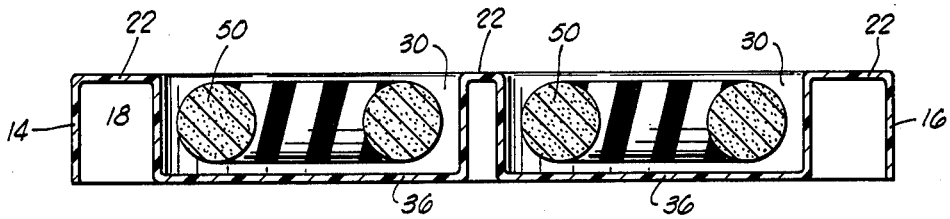
FIG. 3 is a sectional view taken along line 2—2 of FIG. 1.
Figure 4:
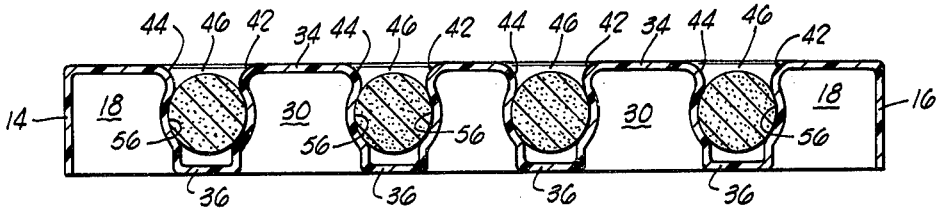
FIG. 4 is a sectional view taken along line 3—3 of FIG. 1.

In referring to FIGS. 2 and 3, it will be perceived that the top panel 22 is molded to provide a plurality of depressions or recesses. In a general sense, these recessed zones in the body 10, and providing parts of the body projecting downwardly from the top panel 22, include a pair of elongated depressions of oval configuration, these being denominated generally by reference numerals A and B in the FIG. 1. It will be perceived that each of the elongated ovals includes a pair of substantially parallel side channels 26 and 28 which are joined at their opposed ends by a pair of rounded semicircular, recessed end portions 30 and 32 at the opposite end of each oval. The side channels 26 and 28 of each oval are effectively formed by means of a central, elongated, raised island 34 disposed between the opposite sides of each oval and extending over a major portion of the length of each oval. Adjacent the opposite ends of each of the islands 34, rounded end portions of each of the oval depressions A and B are formed by a depressed floor or bottom panel 36.

In referring to FIG. 2, it will be perceived that intermediate the length of each of the two side channels 26 and 28 of each of the ovals A and B, a pair of undercut, overhanging flanges 42 and 44 are provided. These flanges, which are molded integrally with the respective islands 34 and with the portion of the top panel 22 which bounds the side channels 26 and 28 of the oval, define between them, a gap or space 46. As illustrated in FIG. 2, this gap or space 46 is of lesser transverse width than the transverse thickness of the leg of a candy cane to be stored in the package.

The candy canes stored in the package are illustrated in the drawings and are denominated by reference numeral 50. Four of such canes are accommodated in the embodiment of the package illustrated, and each is of the conventional or usual configuration, having an elongated leg with a crook or bight portion at one end of this leg. It will further be noted in referring to FIG. 2 that each of the undercut flanges 42 and 46 is connected to a depending throat portion 56 which has a bulge in the center thereof, so that the throat portions depending from each pair of flanges define a generally circular pocket for receiving the leg of the respective candy cane after it has been pressed through the opening 46 between the respective flanges 42 and 44.

With the candy canes 50 stored in the package in the manner described, it will be perceived that each cane is supported by the firm engagement with the central portion of its leg by the throat portions 56 after it has been pressed between the undercut flanges 42 and 44. It will also be perceived that the end portions of each of the canes 50 are supported in spaced relation to the bottom panels 36 located at each of the rounded ends 30 and 32 of each of the oval depressions A and B. The packaging configuration is such that the pairs of flanges 42 and 44 associated with opposite side channels 26 and 28 of each of the ovals A and B are longitudinally offset or staggered from each other so that the canes can be stored in complementary relationship, with the end of the crook or bight portion at one end of the cane immediately adjacent the end of the leg of the other cane.

In referring to FIG. 2, it will be noted that every part of each of the canes, except for the central leg portion, is spaced from any part of the body 10 of resilient synthetic resin material, and any impact upon the package resulting from any outside object is not transmitted through the synthetic resin material directly to the cane. Further, the raised islands 34 and their associated flange pairs 42 and 44 are spaced inwardly from the side walls 14 and 16, and also from the defining vertical boundaries of the rounded semi-circular portions at each end of the ovals A and B so that an insulating effect is obtained protecting the canes from impact or shock forces which may be encountered during storage or shipment.

Any type of suitable cellophane or clear plastic covering can be placed over the package to protect the canes from dust or foreign objects.

From the foregoing description of the invention, it will be perceived that a simple, yet very effective package for holding and protecting candy canes during shipment and storage has been proposed by the present invention. Although various changes and innovations in the illustrated and described structure can be effected without departure from the basic principles which underlie the invention, it will be understood that various changes and innovations can be effected in the illustrated structure without departure from these principles. Changes and innovations of this type are therefore deemed to be circumscribed within the spirit and scope of the invention, except as the same may be necessarily limited by the appended claims or reasonable equivalents thereof.

What is claimed is:

1. A package for packaging a pair of frangible candy canes comprising:

a body of synthetic resin having a top side and a bottom side, and having a pair of oval-shaped depressions therein, each of said oval-shaped depressions including:

a pair of opposed, parallel elongated side channels for receiving the straight legs of a pair of the candy canes;

a central island separating said side channels; and rounded, recessed end portions joining the elongated side channels at opposite ends thereof each for receiving the U-shaped end portion at one end of a candy cane;

said body further including:

pairs of undercut flanges, each flange pair disposed substantially centrally of the length of one of said elongated side channels, and overhanging the respective channel, said flanges in each pair being spaced to define a cane-receiving slot therebetween for receiving through said slot between said flanges one of the elongated straight legs of a candy cane; and throat means below the slot between each of said pair of flanges for spacing a packaged candy cane engaged by said throat means upwardly from the bottom of the respective side channel after the candy cane has been placed downwardly through said candy-receiving slot whereby no portion of either of said canes in a cane pair is susceptible to contact from the top side or the bottom side of said package, and each of the canes in said pair can be removed by rotating the canes in the pair about the axes of their legs to extend the U-shaped end portions of the canes upwardly with respect to the package, thereby allowing the underside of the canes spaced upwardly from the bottom of the package to be accessible for manually prying the canes out of the respective throat means.

2. A package for packing frangible candy canes as defined in claim 1 wherein the pair of said undercut flanges overhanging one of the side channels of each oval-shaped depression is longitudinally offset from the pair of undercut flanges which overhangs the other channel in that same oval-shaped depression.

3. A package for packing frangible candy canes as defined in claim 1 wherein said body is of generally rectangular parallelepiped configuration and is further characterized in including:

a pair of opposed, longitudinally extending side walls;

a transversely extending end wall interconnecting the side walls at one end thereof; and a top panel extending normal to said side walls and interconnecting them, and having said oval-shaped depressions formed therein and extending downwardly from said top panel between said side walls.

4. A package for packing frangible candy canes as defined in claim 3 wherein each of the side channels of each oval-shaped depression is spaced from said side walls, and from said end wall.

5. A package for packing frangible candy canes as defined in claim 4 wherein said body is a molded unitary synthetic resin structure.

6. A package for packing frangible candy canes as defined in claim 1 wherein said throat means comprises a throat portion formed integrally with each of said flanges, each opposed pair of said throat portions forming a generally circular pocket for receiving a part of a piece of candy stored in the package.

7. A molded synthetic resin package for packaging candy canes comprising:

a pair of opposed, substantially vertically extending, parallel side walls;

an end wall extending between and interconnecting said side walls at one end thereof; and a top panel extending between and interconnecting the upper edges of the two opposed side walls and the upper edge of the end wall, said top panel having a candy cane-receiving depression formed therein, said depression comprising:

a pair of spaced, opposed substantially parallel side channels extending substantially parallel to, and spaced from, said side walls each for receiving a leg of a candy cane;

a pair of spaced, rounded semi-circular, recessed end portions each receiving the crook of a candy cane; and means associated with each side channel for engaging the leg of a candy cane and retaining such leg at a location below said top panel and above the lowest portions of said cane-receiving depression.

8. A molded synthetic resin package as defined in claim 7 wherein said means for engaging the leg of a candy cane comprises:

a pair of opposed undercut flanges; and a throat portion connected to each flange in the pair.

* * * * *

UNITED STATES PATENT OFFICE

CERTIFICATE OF CORRECTION

Patent No. 4,158,408 Dated June 19, 1979

Inventor(s) Fred L. Thiessen

It is certified that error appears in the above-identified patent and that said Letters Patent are hereby corrected as shown below:

Col. 6, lines 3-4, after "receiving" delete "a part of a piece of candy" and insert --a leg of a candy cane-- .

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*